US006779528B2

(12) United States Patent
Xue et al.

(10) Patent No.: US 6,779,528 B2
(45) Date of Patent: Aug. 24, 2004

(54) HIGH SURFACE AREA MICRO-POROUS FIBERS FROM POLYMER SOLUTIONS

(75) Inventors: Lixin Xue, Midlothian, VA (US); Kent B. Koller, Chesterfield, VA (US); Qiong Gao, Great Neck, NY (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 10/123,584

(22) Filed: Apr. 16, 2002

(65) Prior Publication Data

US 2003/0116293 A1 Jun. 26, 2003

Related U.S. Application Data

(60) Provisional application No. 60/285,632, filed on Apr. 20, 2001.

(51) Int. Cl.[7] ..... A24B 15/00

(52) U.S. Cl. ..... 131/331; 131/345; 428/400

(58) Field of Search ..... 131/331, 345, 131/202, 200, 201; 428/400, 398; 264/340, 185, 177.13, 211.14; 423/210, 228

(56) References Cited

U.S. PATENT DOCUMENTS 4,252,855 A 2/1981 Noguchi et al.
4,821,750 A * 4/1989 Browne ..... 131/345

OTHER PUBLICATIONS

Colin L. Brown, "The Design of the Cigarettes", Hoechst Celanese Corp., 1990.

* cited by examiner

*Primary Examiner*—Dionne A. Walls
(74) *Attorney, Agent, or Firm*—Connolly Bove Lodge & Hutz LLP

(57) ABSTRACT

Fibers are produced from an acetone solution of cellulose acetate by pulling or extruding such material through a spinneret in a dry spinning process. A vacuum is applied to the thus formed fibers after a certain degree of drying. A dried outer skin is formed, and the vacuum causes the solvent inside the skin to explode or pop and exit the fiber along micro-porous paths thereby producing high surface area fibers with micro-porous cavities and internal void volume. Such micro-cavities are particularly useful for retaining solid and/or liquid reagents in a cigarette filter for selective filtration of various smoke components.

10 Claims, 7 Drawing Sheets

Figure 1 Images of CA Fiber from an Acetone Solution after dried w/ vac. at 60°C (CA 9598-28-3)
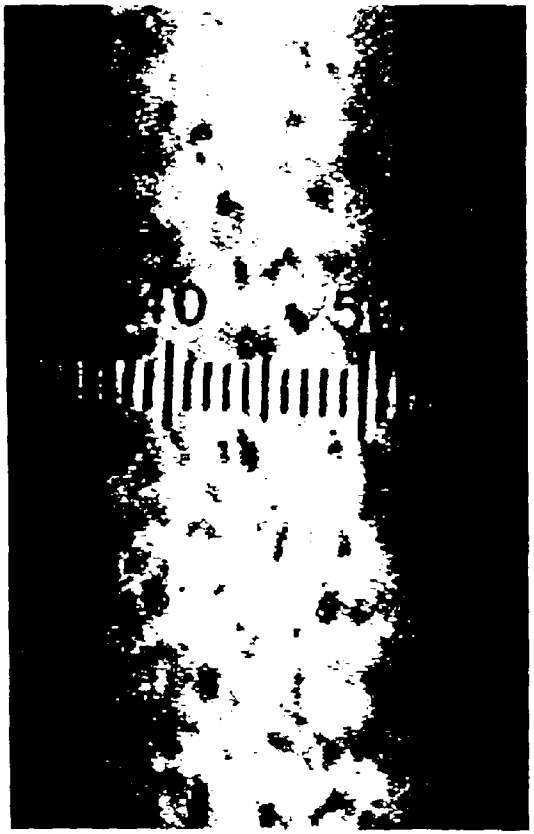
B) Surface view- 1 μm/div.
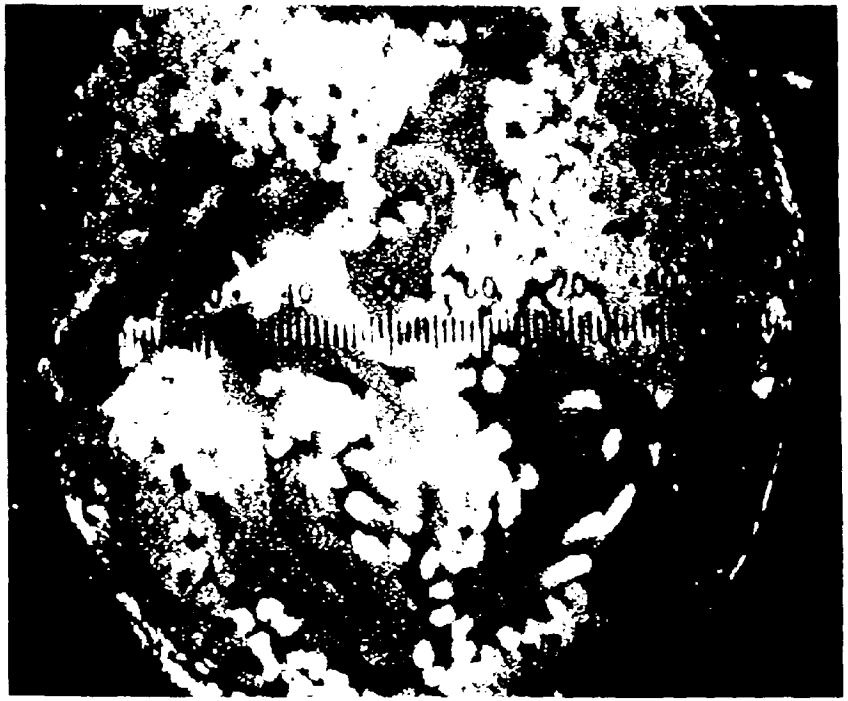
A) Cross Section-2.5 μm/div.

Figure 2 Surface Image of CA Fiber from an Acetone Solution
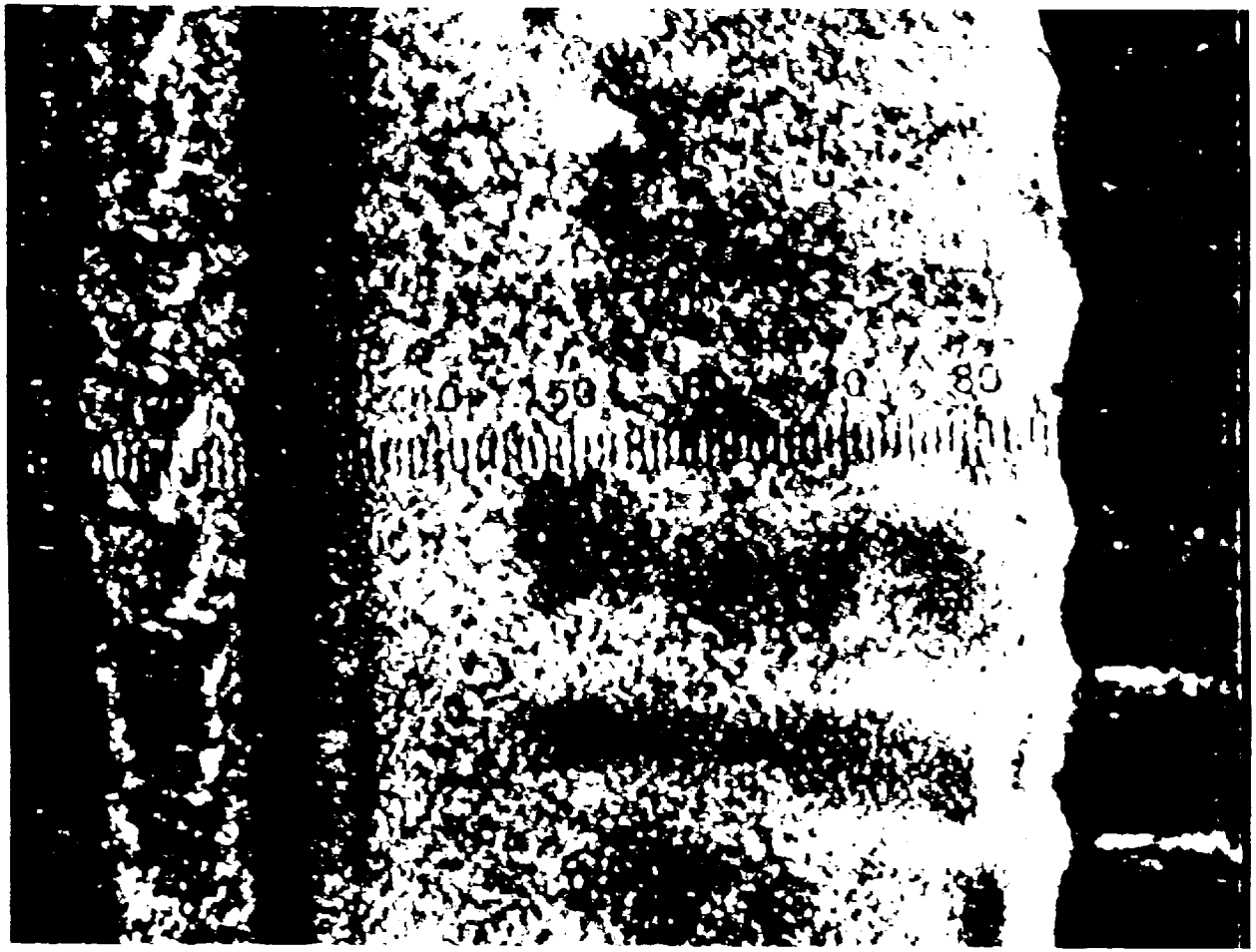
Dried in air at room temperature.(2.5 μm/div., CA 9598-28-4)

Figure 3 Surface Image of CA Fiber from an Acetone Solution Containing Solid $NH_4HCO_3$ Powder
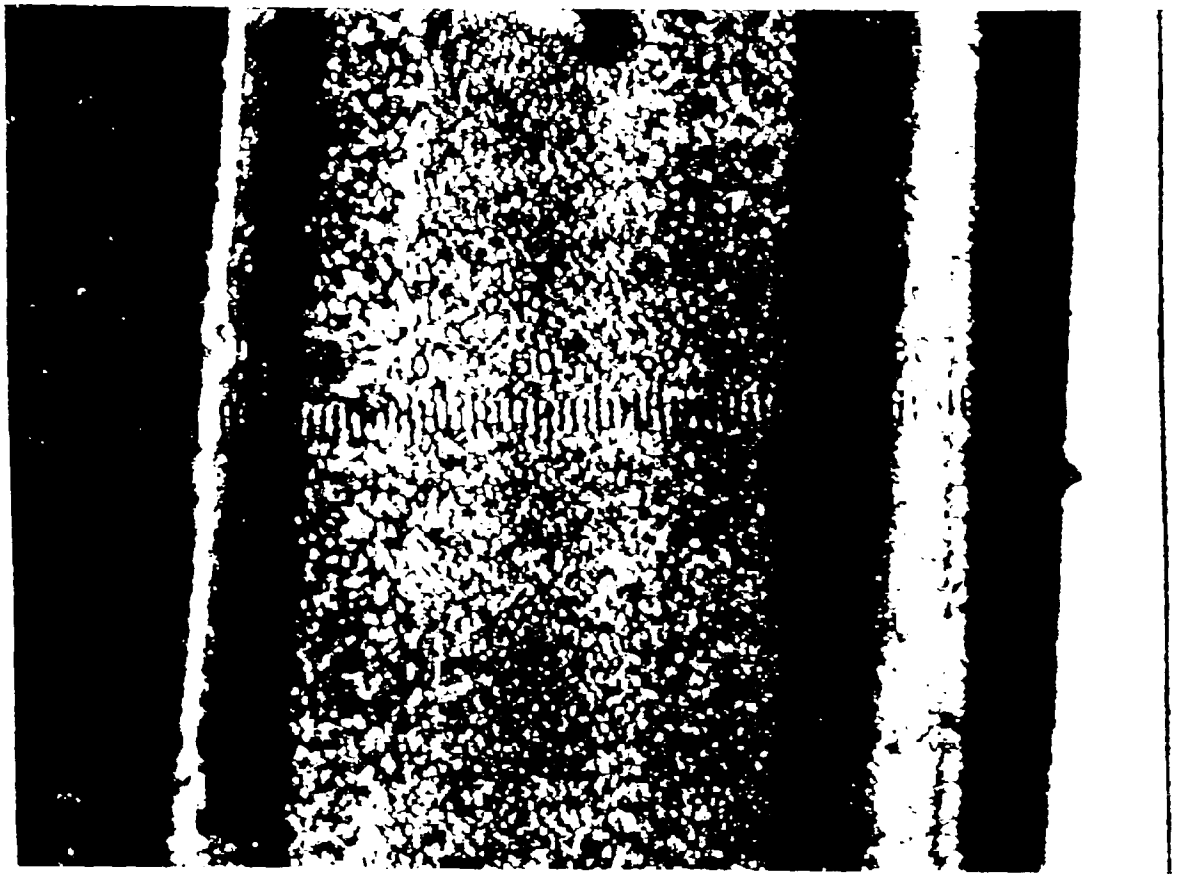
Dried under vacuum/60°C. (2.5 μm/div., CA 9598-29-4)

Figure 4 Surface Image of CA Fiber from an Acetone Solution Containing $NH_4HCO_3/H_2O$ Solution
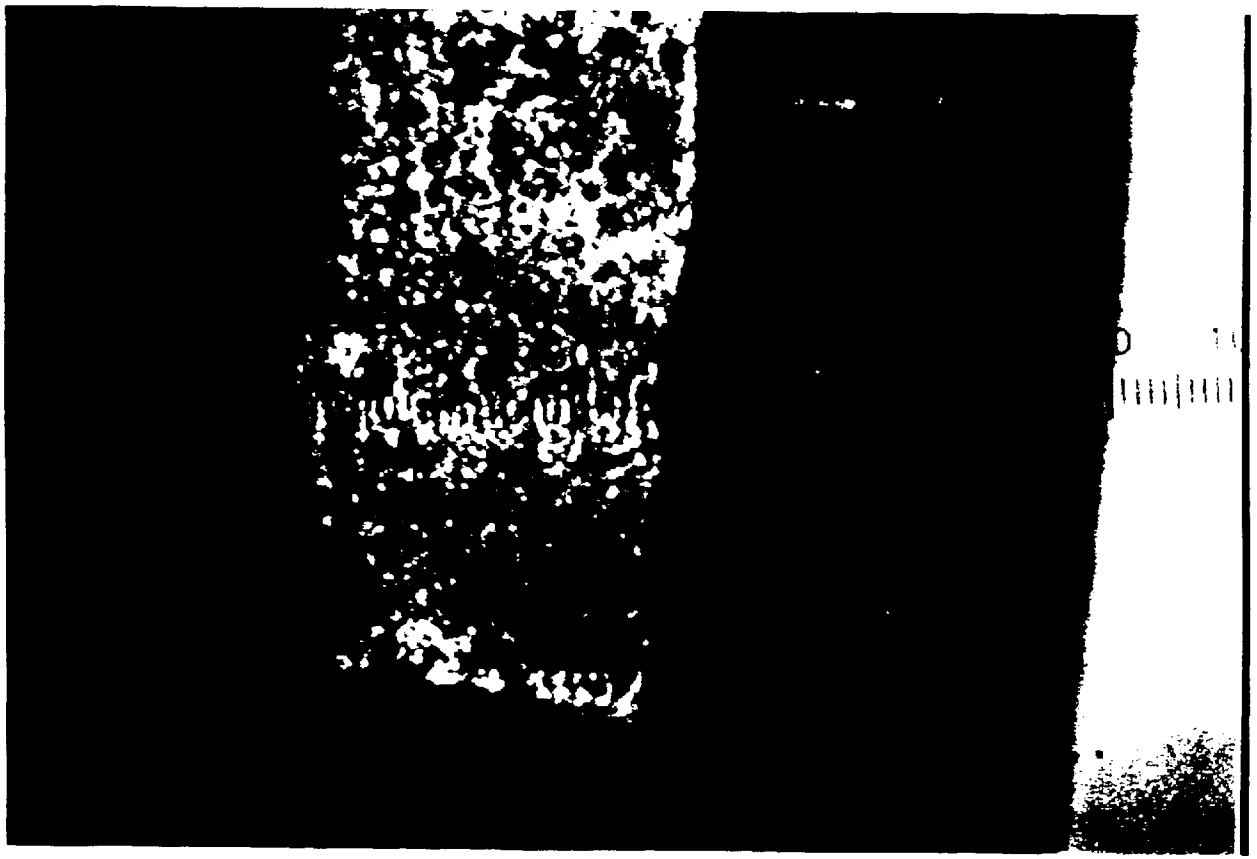
Partially dried in atmosphere (CA 9598-56-2, 2.5 μm/div.)

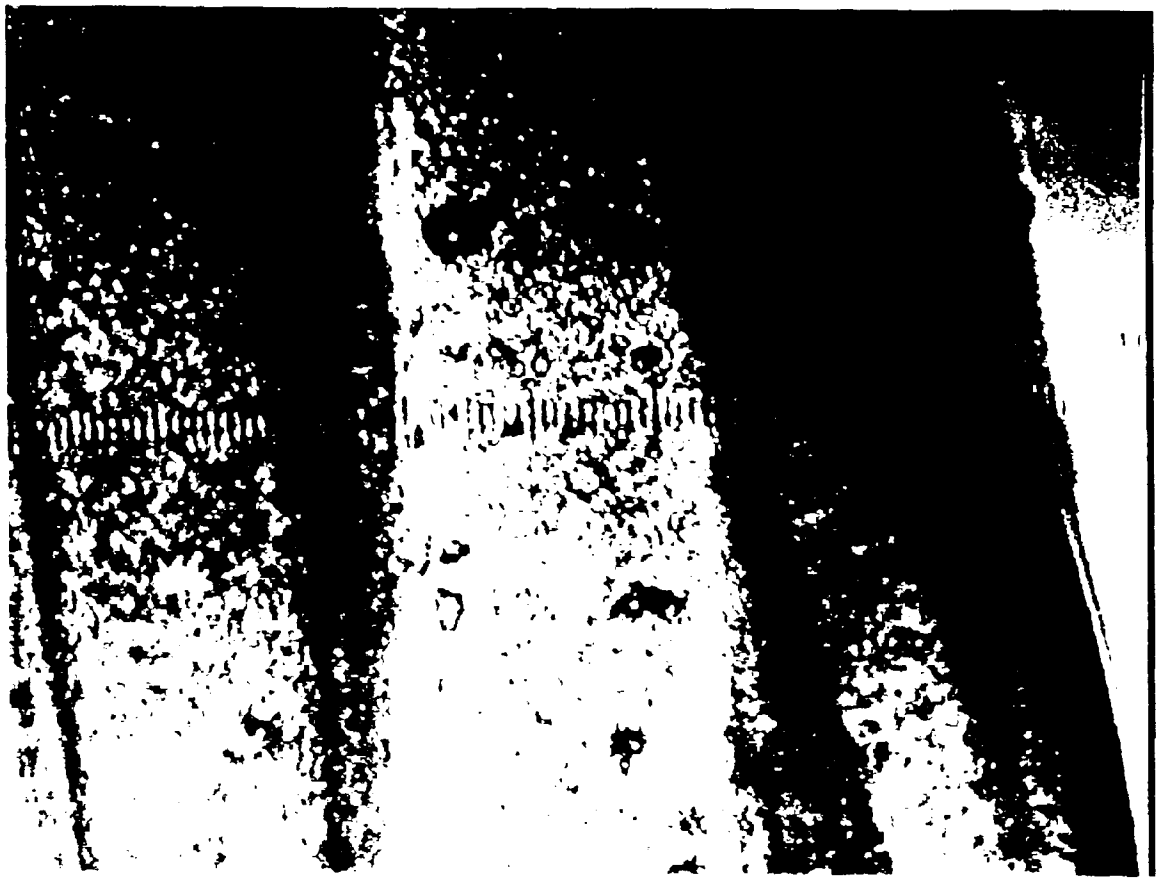
Figure 5 Surface Image of CA Fiber from an Acetone Solution Containing $NH_4HCO_3/H_2O$ Solution Dried at 65°C/Vac. for 30 min. (CA 9598-56-1 2.5μm/div.)

Figure 6 Images of CA Fiber from an Acetone Solution Containing $NH_4HCO_3/H_2O$ Solution
Completely dried at 45-55°C/Vac (CA 9598-57-2b)
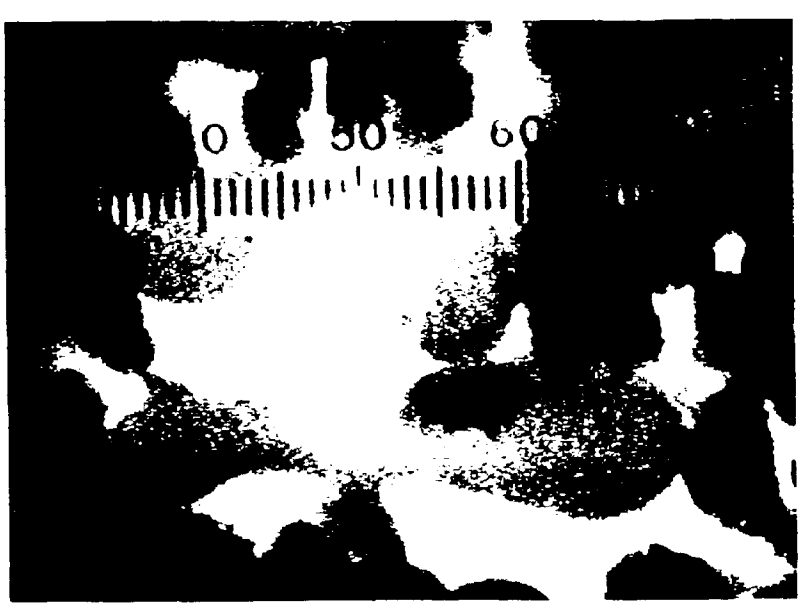
B)-Cross section-2.5 μm/div.
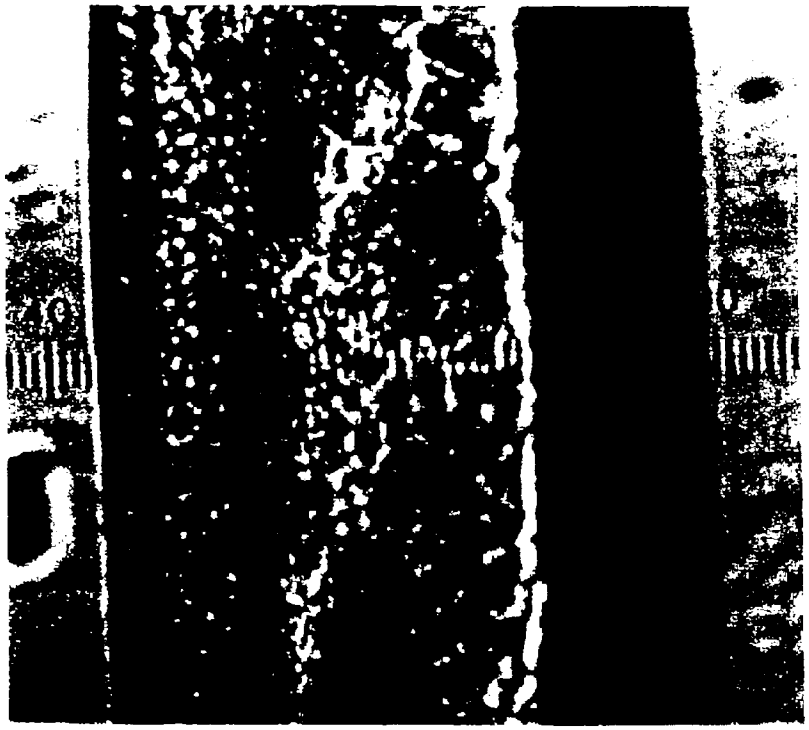
A)-Surface-2.5 μm/div.

Figure 7 Images of CA Fiber from a Viscous Acetone Solution Containing $NH_4HCO_3/H_2O$ Solution Completely dried at 59-62°C/Vac (CA 9598-56-4)
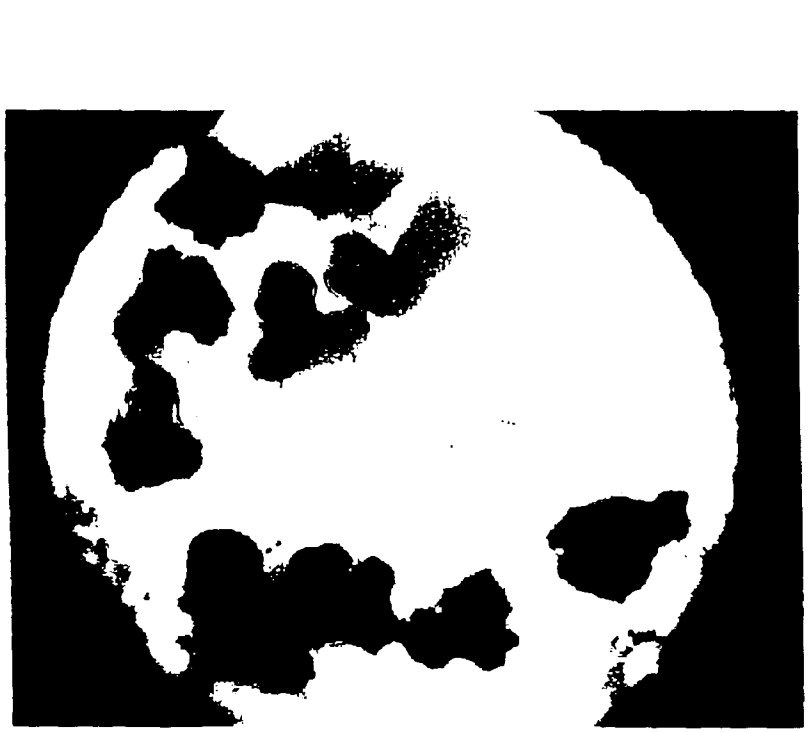
Cross sections-2.5μm/div
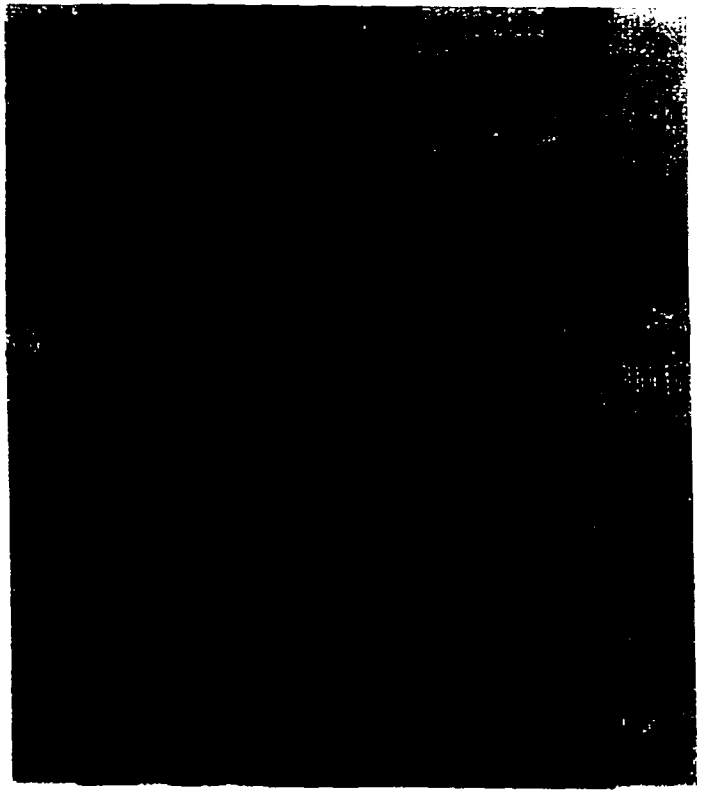
Surface-2.5μm/div

HIGH SURFACE AREA MICRO-POROUS FIBERS FROM POLYMER SOLUTIONS

This application claims the benefit of provisional application No. 60/285,632 filed Apr. 20, 2001.

BACKGROUND OF THE INVENTION

The present invention relates to high surface area micro-porous fibers made from polymer solutions, and particularly high surface area fibers for filtration application where surface micro-cavities are used to retain solid and/or liquid reagents for selective filtration to reduce certain smoke components.

Current cellulose acetate (CA) fibers used in cigarette filters are made by a dry spinning process which allows a 20–25% acetone solution of CA to be pulled or squeezed through the bottom holes of spinerettes or jets, and slowly shrunken into final fiber form by removing acetone solvent in a long spinning column approximately 5–10 meters long. Dried with a pressurized hot air stream in the column, the thus formed fibers with cross-sections such as "R", "I", "Y", and "X" depending on the shape of the holes through which they are pulled or squeezed have a continuous core cross-section and relatively limited outer surface areas because of the heat involved.

SUMMARY OF THE INVENTION

Accordingly, it is an object of the present invention to increase the outer surface area of certain fibers made from polymer solutions by forming micro-cavities useful for retaining solid and/or liquid reagents for selective filtration in the reduction of certain smoke components in tobacco products such as cigarettes.

Another object of the present invention is a process for producing high surface area fibers for filtration application in tobacco products such as cigarettes.

Still another object of the present invention is a process of producing high surface area fibers from polymer solutions where micro-cavities on the fiber surface are used to retain solid and/or liquid reagents for selective filtration in the reduction of certain smoke components in tobacco products.

In accordance with the present invention, a polymer solution is allowed to pull through the spinneret of a dry spinning process. A rapid evaporating process at reduced pressure is applied to the initial form of the fibers after a certain degree of drying in air-spinning columns where a dried skin of polymer is formed on the fiber surface. A residual amount of solvent or a blowing agent inside this skin explodes or pops and quickly leaves the fiber through various micro-porous paths under reduced pressure, leaving behind high surface area fibers with micro-porous cavities and internal void volume. For cellulose acetate fibers, an evaporating temperature below 60° C. in the evaporating process is essential in order to preserve the thus formed micro-pores in the fiber surfaces.

The process can be extended to polymer materials other than cellulose acetate as well as solvents and so called popping agents other than acetone. Also, suitable fibers are fibers from a melt polymer dope with air trapped in a chilled hard outer skin. The low temperature evaporation process can be applied in an on-line or in a batch manner.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which:

FIG. 1A is a microscopic surface image of a fiber produced according to Example 1 of the present invention;

FIG. 1B is a microscopic cross-sectional view of a fiber produced according to Example 1 of the present invention;

FIG. 2 is a microscopic surface image of a fiber produced according to Example 2 of the present invention;

FIG. 3 is a microscopic surface image of a fiber produced according to Example 3 of the present invention;

FIG. 4 is a microscopic surface image of a partially dried fiber produced according to Example 4 of the present invention;

FIG. 5 is a microscopic surface image of a fiber dried at approximately 65° C. produced according to Example 4 of the present invention;

FIG. 6A is a microscopic surface image of a fiber dried at approximately 45–55° C. produced according to Example 4 of the present invention; and FIG. 6B is a microscopic cross sectional view of the fiber shown in FIG. 6A.

FIG. 7 is a microscopic surface and cross-sectional view of fiber produced according to another embodiment of the present invention.

DETAILED DESCRIPTION OF THE INVENTION

The following are specifics and examples of the present invention.

A. Preparation of CA/acetone solution. To a 100-ml three-necked round bottom flask equipped with mechanical stirring and glass plugs, 50-ml of acetone (Fisher Scientific, 99.6%) is added and then 11.88 g of CA tow fiber under medium stirring. After the addition, the bottle was plugged, and the added fiber was slowly dissolved into the solvent forming a homogenous white viscous solution overnight.

B. Dry spinning process to form fiber. About 10-ml of above solution was slowly transferred into a 10-ml extrusion barrel via a plastic syringe equipped with plastic tubes. The barrel was then installed onto a DACA 9-mm Piston Extruder Model 40000 with a round single hole 0.75-mm die and extruded at room temperature with a piston speed of 20 mm/minute. The extruded fiber was collected in an aluminum tray after dropping vertically in a 21-cm solvent venting distance created by the combination of two air blowing nozzles and an exhaust-venting hood. The residual of the solvent was further rapidly evaporated either by high vacuum in a vacuum oven or high airflow in a hood.

EXAMPLE-1

Fibers Obtained After Drying at 60° C. under Vacuum

In this example, the above fiber was collected on a metal pan and then put into a vacuum oven at 60° C. A mechanical pump generated a high vacuum inside this oven through a dry-ice trap. The trapped solvents rapidly evaporated and formed micro-pores on the fiber surfaces. FIGS. 1A and 1B show the microscopic surface and cross sectional views of the formed fiber after drying at 60° C. under vacuum for 20 minutes. It is clear that pores in the diameters of about 1-micrometer were formed. These pores are so small that they can only be observed in a 1000× images (1 micrometer/ division) not in a 400× images (2.5 micro meters/division). The porous structure was also found stable in storage for more than 3 months.

The fiber samples in this example did not maintain their round cross section as shown in FIGS. 1A and 1B because they are collected and dried in horizontal positions. They shrink anisotropically into flat dog bone-shapes with cross sectional dimensions from 25–150 micrometers. It is possible to shrink the fibers into the round cross sections by handling them vertically without touch in the process. This example and the following examples are only used to demonstrate the spirit of modifying the surface porosity of the cellulose acetate fiber and is not used to limit the scope of the invention. The resultant porous fiber can be of any cross sectional shape.

EXAMPLE-2

Porous Fibers Obtained from Lower Temperature Evaporating Process

In this example, the above spun fiber samples was further dried at a no-heating process. The residual solvent was removed by rapid pumping in a vacuum oven without heat or in a highly vented hood at room temperature for 25 minutes. The typical surface images of the resulted samples are shown in FIG. 2. Larger pores with diameters up to 3 micrometers are visible in even in a 400× image. It is obvious, the temperature and the pressure are playing significant roles in the final form of porosity on the fiber surface.

EXAMPLE-3

Experiments with Solid Ammonium Hydrogen Carbonate (AHC) Agents

Ammonium hydrogen carbonate ($NH_4HCO_3$, AHC) is known blowing agent in the manufacture of porous plastics. It decomposes at about 60° C. to give off $CO_2$, $NH_3$ and $H_2O$. In this example, a solid form of this agent is used to form large pores in the fiber. The setup of preparation and spinning of fiber is the same as Example 1. The experiments started with mixing 2.0 g of solid AHC powder (Aldrich, 99%) with 40 ml cellulose acetate acetone solution, as described for example 1. After mechanically stirring overnight, all the solid particles were mixed into the solution. 10 ml of this mixture was then spun in the DACA piston extruder. When a 1.25 mm dies was used, no continuous filament could be drawn. When a 0.5-mm round cross section die was used at a speed of 30.4 mm/minutes, the formed contiguous fiber filament was collected by manually winding on a80-mm bobbin after a 130 cm long dropping distance. However, there are large solid particles found deposit on the bottom of the barrel before passing through die. It may be that only a small amount of the agent was actually passed through the die to be incorporated into the fiber in this case. After decomposing the regents and removing the residual solvents under vacuum at a temperature of about 60° C. for 25 minutes, pores with diameters up to 2.5 micrometers are observed on the fiber surface as shown in FIG. 3. The pores formed in this example are much larger than those in Example 1 because of the existence of small amount of blowing agent. To have an even larger effect, additional blowing agent must pass through the die without breaking the fiber. This can be incorporated by using blowing agents in sub-micrometer solid particulate form or dissolved forms in following example.

EXAMPLE 4

Experiments with Dissolved Ammonium Hydrogen Carbonate (AHC) Agents

A. Preparation of $NH_4HCO_3/H_2O$ solution. 2.0 g of above AHC solid was slowly added into a beaker containing 10.0 g of distilled water at room temperature under magnetic stirring. After the solid particles were dissolved, the formed solution was stored at a low temperature in a closed vial.

B. Preparation of CA/acetone solution containing $NH_4HCO_3/H_2O$. To a 100-ml three-necked round bottom flask equipped with mechanical stirring and glass plugs, 50-ml of acetone (Fisher Scientific 99.6%) was added and then 12.5 g of CA tow fiber under medium stirring. After the addition, the bottle was plugged, and the added fiber was slowly dissolved into the solvent and a homogeneous white viscous solution formed overnight. Then, 1-ml of the above prepared AHC solution was added to the solution under vigorous mechanical stirring. After the addition, the mixture was continued to be stirred moderately for at least 1 h before use.

C. Dry spinning process to form fiber with large pores. About 10-ml of above solution was transferred into a 10-ml extrusion barrel by plastic syringe through a plastic tube. The barrel was then installed onto the DACA 9-mm Piston Extruder Model 40000 with a round single hole 1.5-mm die and extruded at room temperature at a piston speed of 20 mm/minute. The extruded fiber was collected in an aluminum tray after dropping vertically in a 130-cm pre-drying distance created by the combination of two air blowing nozzles and an exhaust-venting hood. Due to the decomposition of AHC in the mixture, large pores with diameters up to 5–10 micrometers are observed on the surface this partially dry sample as shown in FIG. 4. However, this structure was not stable because of the existence of residual solvent. It relaxed back to a more stable structure with smaller pores as shown in FIG. 2 after storage at room temperature at atmospheric are pressure.

To fully remove the residual of solvent, 105.6 mg of above collected fiber was further treated in a vacuum oven at a temperature from 60–65° C. for 30 minutes 99.6 mg of dry fiber was obtained after about 6% of residual solvent was removed. The surface of the fiber is shown in FIG. 5. Due to heating, the portion of the original big pores were destroyed by the polymer chain motion and relaxed back to smaller pores with diameters of about 1 micrometer similar to that in Example 1. Interestingly, some of the super large pores with diameter of 10–15 micrometers survived the process.

To preserve the formed porous structure, the fiber should be treated at a lower temperature with shorter time under high vacuum. Residual solvents (about 5–7%) can be effectively removed in a 5 minutes high vacuum oven treatment at a temperature about 50° C. For example, 1.7580 g of the above partially dried fiber was treated in the vacuum oven only for 5 minutes at 45–55° C., resulting in 1.6333 g of dried fiber. As shown in FIGS. 6A and 6B, large pores with diameters from 3–5 micrometers were formed in the dry fiber surface. This porous structure was also found to be stable at room temperature for long time storage.

A further embodiment includes cellulose acetate fibers prepared from a viscous acetone solution containing $NH_4HCO_3/H_2O$ solution that is completely dried at 59–62° C./Vac, as shown in FIG. 7.

In summary, the above examples demonstrate that pores with diameters from 1–15 micrometers may be formed by evaporating rapidly residual solvents or blowing gasses through the fiber surface skin during or after a dry spinning process. These pores render higher accessible contacting surface area for the fiber to contact gas phase adsorbates, and also provide a inner fiber space to accommodate additional adsorbents/reagents for filtration application. To preserve the formed pores larger than 1 micrometer in diameter, a low temperature evaporating process with reduced pressure are preferred.

What is claimed is:

1. A cellulose acetate fiber having an outside surface area with a plurality of micro-porous cavities that inwardly extend from pores on the surface into the fibers, and the fibers having a partial internal void volume, and wherein the pores on the surface of the fibers have diameters of at least 1 micrometer.

2. A cellulose acetate fiber as in claim 1 wherein the pores on the surface of the fibers have diameters in the range of 1 to 3 micrometers.

3. A cellulose acetate fiber as in claim 1 wherein the pores on the surface of the fibers have diameters in the range of 1 to 15 micrometers.

4. A cellulose acetate fiber having an outside surface area with a plurality of micro-porous cavities that inwardly extend from pores on the surface into the fibers, and the fibers having a partial internal void volume, and the fiber being produced by a process comprising the steps of:

passing an acetone solution of cellulose acetate through a spinneret to form fibers;

partially diving the formed fibers to produce a skin on the outside of the fibers; and applying a vacuum to the formed fibers after a predetermined degree of drying to thereby cause the acetone inside the formed fibers to explode or pop and exit the fibers through the skin along micro-porous paths whereby micro-porous cavities are formed on the outside of the outside surface of the fibers extending to inside the fibers, and wherein the pores on the surface of the fibers have diameters of at least 1 micrometer.

5. A cellulose acetate fiber as in claim 4 wherein the pores on the surface of the fibers have diameters in the range of 1 to 3 micrometers.

6. A cellulose acetate fiber as in claim 4 wherein the pores on the surface of the fibers have diameters in the range of 1 to 15 micrometers.

7. A cigarette filter element comprising a plurality of cellulose acetate fibers each having an outside surface area with a plurality of micro-porous cavities that inwardly extend from cores on the surface into the fibers, and solid and/or liquid reagent retained within the micro-cavities for selective filtration of tobacco smoke, and wherein the pores on the surface of the fibers have diameters of at least 1 micrometer.

8. A cigarette filter element as in claim 7 wherein the pores on the surface of the fibers have diameters in the range of 1 to 3 micrometers.

9. A cigarette filter element as in claim 7 wherein the pores on the surface of the fibers have diameters in the range of 1 to 15 micrometers.

10. A cellulose acetate fiber having an outside surface area with a plurality of micro-porous cavities that inwardly extend from pores on the surface into the fibers, and the fibers having a partial internal void volume, the fiber being produced by a process comprising the steps of:

passing an acetone solution of cellulose acetate containing a blowing agent through a spinneret to form fibers having surface pores with diameters up to 5 to 10 micrometers as gas is released from the blowing agent after passing through the spinneret; and rapidly drying the fibers under vacuum at a temperature in the range of 60 to 65° C.

* * * * *

UNITED STATES PATENT AND TRADEMARK OFFICE

CERTIFICATE OF CORRECTION

PATENT NO. : 6,779,528 B2
DATED : August 24, 2004
INVENTOR(S) : Lixin L. Xue et al.

It is certified that error appears in the above-identified patent and that said Letters Patent is hereby corrected as shown below:

Column 5,
Line 30, “diving” should read -- drying --.

Column 6,
Line 13, “cores” should read -- pores --.

Signed and Sealed this

Fourteenth Day of December, 2004

JON W. DUDAS
*Director of the United States Patent and Trademark Office*